US010772424B2

(12) United States Patent
Turner

(10) Patent No.: US 10,772,424 B2
(45) Date of Patent: Sep. 15, 2020

(54) SHELVING SYSTEM

(71) Applicant: Brian Wesley Turner, Mooretown (CA)

(72) Inventor: Brian Wesley Turner, Mooretown (CA)

( * ) Notice: Subject to any disclaimer, the term of this patent is extended or adjusted under 35 U.S.C. 154(b) by 0 days.

(21) Appl. No.: 16/276,526

(22) Filed: Feb. 14, 2019

(65) Prior Publication Data

US 2019/0281982 A1 Sep. 19, 2019

Related U.S. Application Data

(60) Provisional application No. 62/643,574, filed on Mar. 15, 2018.

(51) Int. Cl.
*A47B 96/04* (2006.01)
*A47B 57/58* (2006.01)

(52) U.S. Cl.
CPC ..... *A47B 96/04* (2013.01); *A47B 57/58* (2013.01)

(58) Field of Classification Search
CPC ..... A47B 96/04; A47B 57/08; A47B 57/10; A47B 57/58; A47F 5/005; A47F 5/0062; A47F 5/132
USPC ..... 211/184
See application file for complete search history.

(56) References Cited

U.S. PATENT DOCUMENTS 1,739,730 A * 12/1929 Orthwine ..... A47F 5/0062 211/128.1
2,230,547 A * 2/1941 Royer ..... A47F 5/005 312/140.3
2,885,091 A * 5/1959 Van Pelt ..... A47F 5/005 211/184
3,868,021 A * 2/1975 Heinrich ..... A47B 57/585 211/184
4,675,970 A * 6/1987 Galen ..... A47B 57/58 108/61
4,676,384 A * 6/1987 Schafer ..... A47B 57/58 211/184
4,768,661 A * 9/1988 Pfeifer ..... A47F 5/005 211/184
5,381,908 A * 1/1995 Hepp ..... A47B 57/585 108/61
5,664,856 A * 9/1997 Pacetti ..... A47B 88/994 312/348.3
6,244,447 B1 * 6/2001 Frieze ..... A61L 2/07 206/370

(Continued)

*Primary Examiner* — Patrick D Hawn

(74) *Attorney, Agent, or Firm* — Gulf Coast Intellectual Property Group

(57) ABSTRACT

A shelving system that includes a plurality of horizontal support shelves and a plurality of vertical dividers wherein the vertical dividers are configured to extend vertically intermediate adjacent shelves and provide segmentation of the shelf to which the vertical divider is secured. The vertical divider of the shelving system includes a first portion and a second portion wherein the second portion is slidably secured within the interior volume of the first portion. The first portion includes a front wall having a slot formed therein wherein a slider is movably secured within the slot and is operable to provide adjustment of the second portion so as to alter the height of the vertical divider. The vertical dividers include a first fastener and a second fastener secured to opposing ends thereof that are operable to releasably secure the vertical dividers.

1 Claim, 3 Drawing Sheets

(56) References Cited

U.S. PATENT DOCUMENTS 6,389,993 B1 * 5/2002 Ondrasik ..... A47F 1/12 108/107
7,681,746 B2 * 3/2010 Schmidt ..... A47F 5/005 211/184
7,703,866 B2 * 4/2010 Benz ..... F25D 25/02 211/184
7,806,282 B1 * 10/2010 LaBonia, Jr. ..... A47B 67/04 211/135
8,556,092 B2 * 10/2013 Valiulis ..... A47F 5/005 108/61
8,833,881 B2 * 9/2014 Manniso ..... A47B 88/994 312/348.3
9,700,156 B1 * 7/2017 Hance ..... A47F 5/005
10,174,991 B2 * 1/2019 Parkes ..... A47B 71/00
10,206,520 B2 * 2/2019 Hardy ..... A47F 1/126
2002/0104466 A1 * 8/2002 Carson ..... A47F 1/12 108/110
2002/0187016 A1 * 12/2002 Kopperud ..... B60P 7/14 410/129
2006/0226104 A1 * 10/2006 Schmidt ..... A47F 5/005 211/184
2007/0158281 A1 * 7/2007 Hardy ..... A47F 1/04 211/59.3
2008/0295976 A1 * 12/2008 Watanabe ..... A47B 88/994 160/131
2013/0213916 A1 * 8/2013 Leahy ..... A47F 5/005 211/151
2013/0306583 A1 * 11/2013 Caldwell ..... A47B 57/581 211/181.1
2014/0097149 A1 * 4/2014 Hardy ..... A47F 1/126 211/59.3
2014/0305892 A1 * 10/2014 Hardy ..... A47F 1/126 211/59.3
2016/0081492 A1 * 3/2016 Hardy ..... A47F 1/126 211/59.3
2019/0281982 A1 * 9/2019 Turner ..... A47B 57/58

* cited by examiner

SHELVING SYSTEM

PRIORITY UNDER 35 U.S.C Section 119(e) & 37 C.F.R. Section 1.78

This nonprovisional application claims priority based upon the following prior U.S. Provisional Patent Application entitled: Modular Partition Systems, Application No. 62/643,574 filed Mar. 15, 2018, in the name of Brian Wesley Turner, which is hereby incorporated by reference for all purposes.

FIELD OF THE INVENTION

The present invention relates generally to storage apparatus, more specifically but not by way of limitation, a shelving system wherein the shelving system includes a plurality of adjustable horizontal shelves and further includes a plurality of vertical dividers configured to be releasably secured to the horizontal shelves so as to provide division thereof for organization of items.

BACKGROUND

Storage apparatus are well known in the art. Whether for commercial purposes or for residential needs various apparatus are utilized to store items and provide subsequent availability. Commonly utilized storage apparatus include filing cabinets and bin systems wherein these apparatus typically store smaller items and provide full enclosure of the item. Shelving systems are another type of apparatus that are commonly utilized to provide storage of items. As is known in the art, shelving systems typically include at least one horizontal support surface and can be either mounted to a wall or can be provide with supports wherein the supports can be either fixed or be movably mounted with wheels or similar item. Conventional shelving systems can be manufactured from various materials but are often manufactured from wood or metal.

One common type of shelving system are commercial wire shelves. These shelving systems are configured with four corner upright mounting posts and have a plurality of horizontal shelves operably coupled thereto. The horizontal shelves are adjustable wherein each shelf can be placed in a different vertical position and as such provide varying heights present intermediate each shelf. While the shelf positions are adjustable, one deficiency with these existing shelving systems is the inability to compartmentalize the space on one of the shelves. Many times, various alternate objects are placed on a shelf in a commercial environment. These objects often have different sizes and other characteristics wherein separation thereof is desirable.

Accordingly, there is a need for a shelving system that is configured to have a plurality of horizontal shelves and further wherein the shelving system includes a plurality of vertical dividers that are operable to segment a single horizontal shelf.

SUMMARY OF THE INVENTION

It is the object of the present invention to provide a shelving system that is configured to be portable and provide storage of a plurality of items, wherein the shelving system includes a plurality of horizontal shelves.

Another object of the present invention is to provide a shelving system that provides segmentation of each horizontal shelf wherein the shelving system is designed to be portable.

A further object of the present invention is to provide a shelving system that is configured to be portable and provide storage of a plurality of items wherein the horizontal shelves are adjustable so as to have alternate distances between an adjacent horizontal shelf.

Still another object of the present invention is to provide a shelving system that provides segmentation of each horizontal shelf wherein the segmentation of the horizontal shelf is provided utilizing a vertical divider.

An additional object of the present invention is to provide a shelving system that is configured to be portable and provide storage of a plurality of items wherein the vertical divider of the shelving system includes a first portion and a second portion.

Yet a further object of the present invention is to provide a shelving system that provides segmentation of each horizontal shelf wherein the second portion of the vertical divider is movably secured within the first portion of the vertical divider.

Another object of the present invention is to provide a shelving system that is configured to be portable and provide storage of a plurality of items wherein the first portion is movably in an upwards-downwards direction so as to provide alternate heights of the vertical divider.

Still a further object of the present invention is to provide a shelving system that provides segmentation of each horizontal shelf wherein the vertical divider of the shelving system is configured to be releasably secured in alternate positions on the horizontal shelves of the shelving system.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
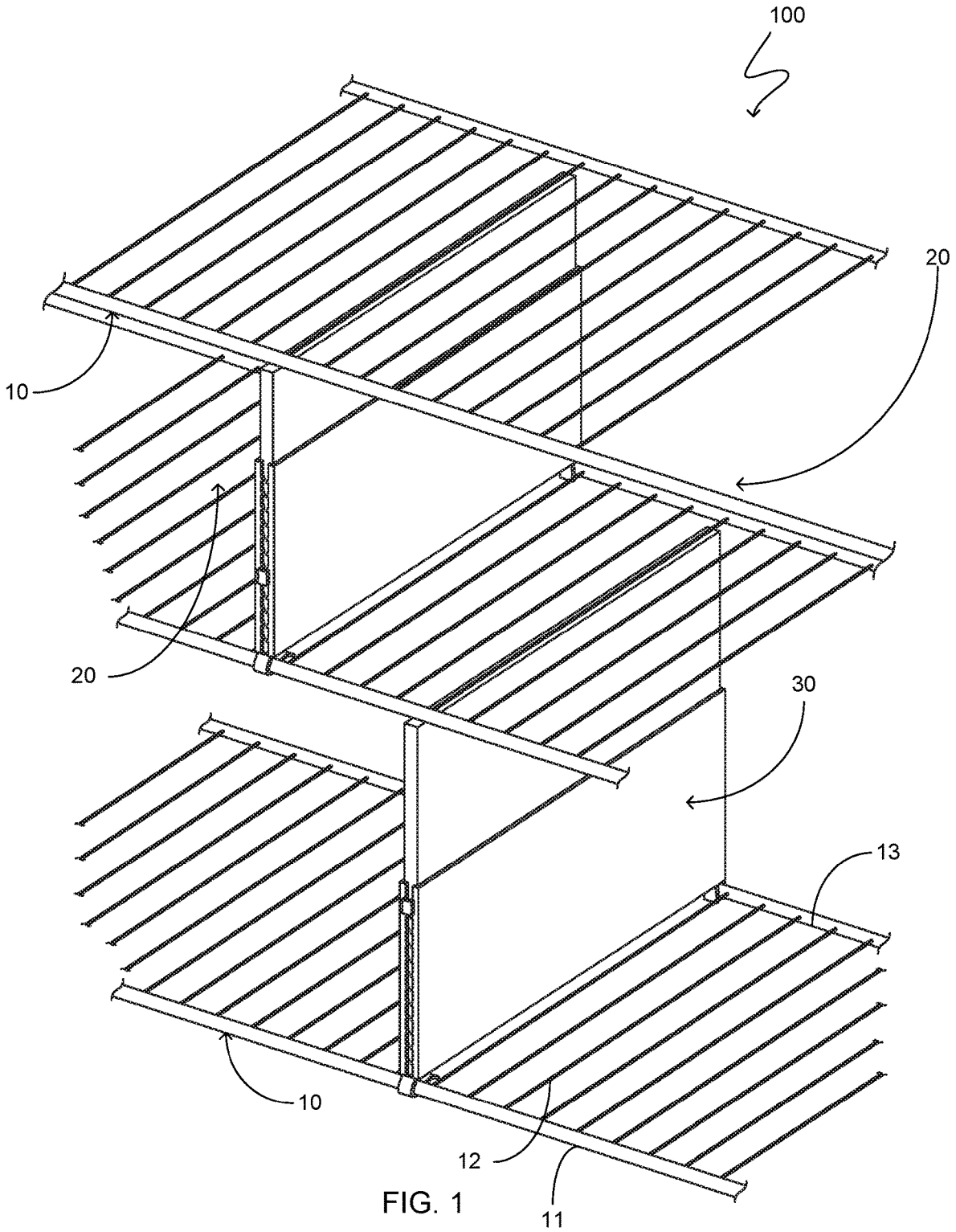
FIG. 1 is a perspective view of a portion of an embodiment of the present invention.
Figure 2:
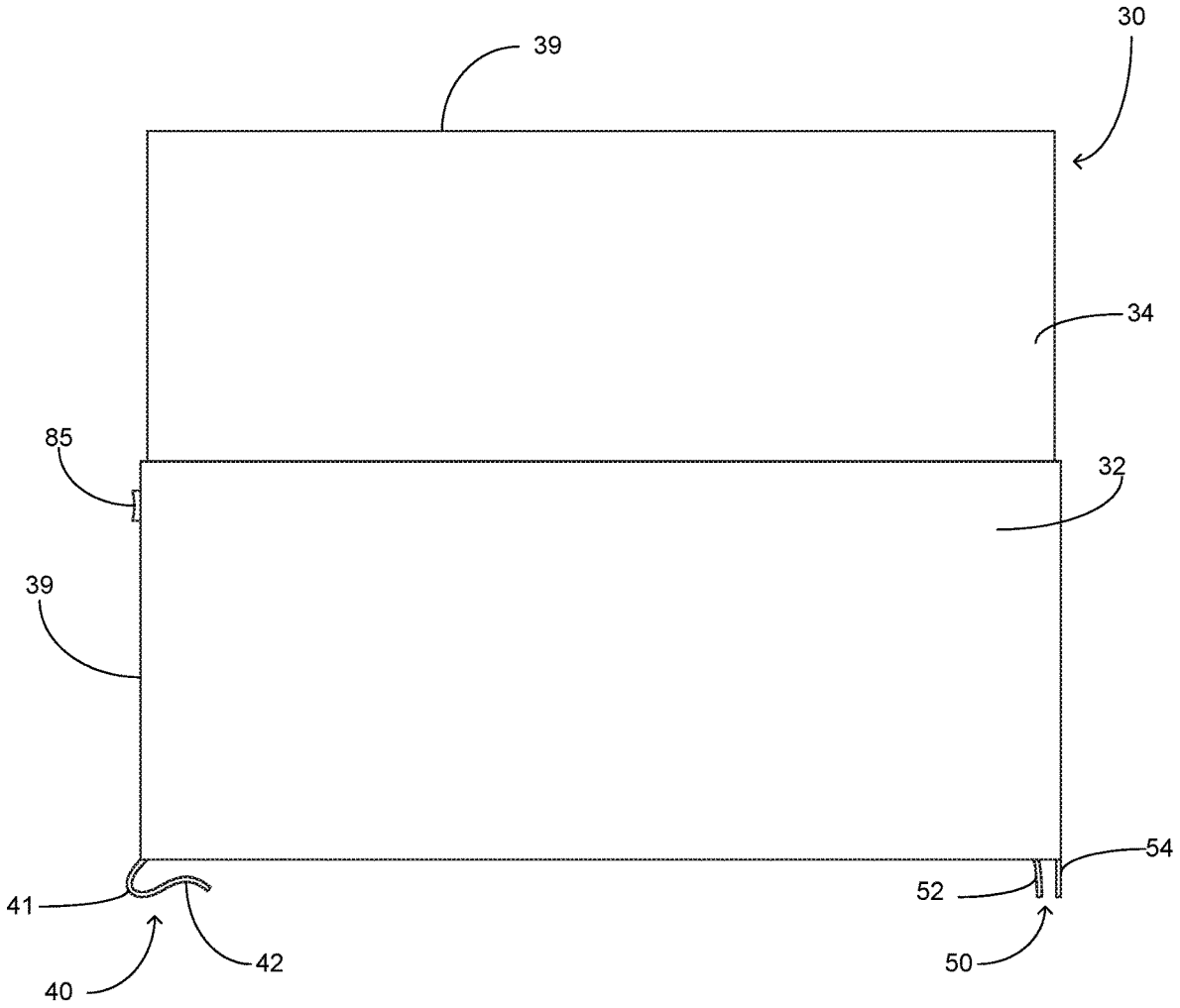
FIG. 2 is a side view of a vertical divider of the present invention.
Figure 3:
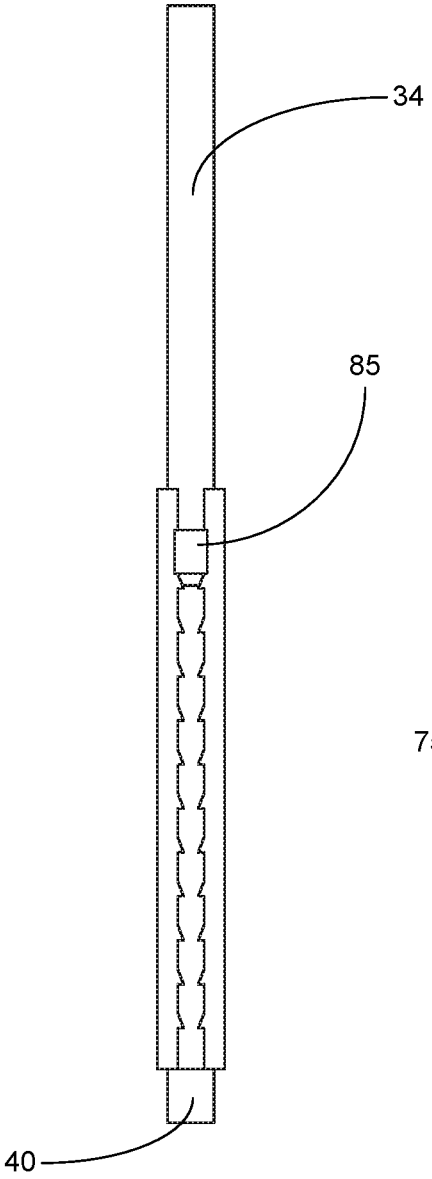
FIG. 3 is a front view of the vertical divider of the present invention in its second position.
Figure 4:
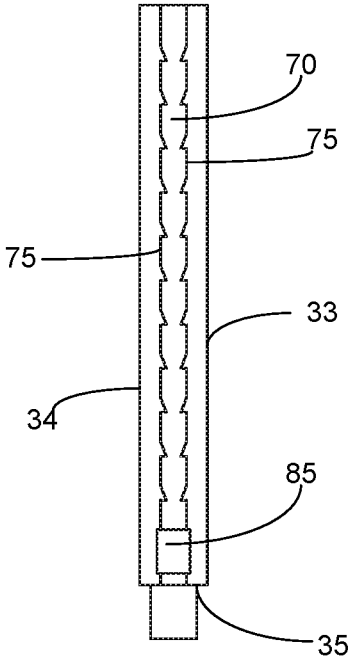
FIG. 4 is a front view of the vertical divider of the present invention in its first position.

Referring now to the drawings submitted herewith, wherein various elements depicted therein are not necessarily drawn to scale and wherein through the views and figures like elements are referenced with identical reference numerals, there is illustrated a shelving system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures submitted as a part hereof, the shelving system 100 includes a plurality of horizontal shelves 10. The horizontal shelves 10 are releasably secured to corner support posts (not illustrated herein) and are configured so as to be secured at alternate heights with respect to each other. It is contemplated within the scope of the present invention that the horizontal shelves 10 are movably coupled to conventional corner support posts so as to provide alternate heights thereof for the shelving system 100. The horizontal shelves 10 illustrated herein include a front support bar 11, rear support bar 13 and a plurality of support members 13 therebetween. The illustrated embodiment of the horizontal shelves 10 are manufactured from tubular metal and are secured utilizing suitable durable material such as but not limited to welding. While the embodiment illustrated herein depicts the horizontal shelves 10 as metal wire shelves, it is contemplated within the scope of the present invention that the horizontal shelves 10 could be manufactured from numerous alternate materials and further be constructed so as to be a solid piece of material. It should be further understood within the scope of the present invention that the horizontal shelves 10 could be manufactured in various alternate shapes and sizes.

The vertical dividers 30 are releasably secured intermediate the horizontal shelves 10 wherein the vertical dividers 10 extend intermediate horizontal shelves 10 that are vertically adjacent. The vertical dividers 30 function to laterally divide the horizontal shelves 10 into segments 20. The vertical dividers 30 are releasably secured to the horizontal shelves 10 utilizing a first fastener 40 and second fastener 50. The vertical divider 30 includes a first portion 32 and second portion 34. The second portion 34 is movably mounted to the first portion 32 so as to provide height adjustment of the vertical divider 30. The vertical divider 30 is manufactured from a durable lightweight material such as but not limited to plastic. It is contemplated within the scope of the present invention that the vertical divider 30 could be present within the shelving system 100 in numerous alternate quantities as needed to create the desired number of segments 20.

The first portion 32 of the vertical divider 30 includes a first wall 33, a second wall 34 and a bottom 35 integrally formed to create an interior volume. The front wall 36 of the first portion 32 of the vertical divider 30 further includes a slot 70 formed therein. The slot 70 includes a plurality of notches 75 that are configured to receive and retain the slider 85. It should be understood within the scope of the present invention that the slot 70 could be formed with an alternate quantity of notches 75. The notches 75 function to engage the slider 85 and provide control of the height adjustment of the vertical divider 30 by providing alternate positions of the second portion 34. The second portion 34 is movably secured within the interior volume of the first portion 32. The second portion 34 is slidable wherein the slidable movement is facilitated through engagement of the slider 85.

The second portion 34 is manufactured from a solid piece of material such as but not limited to plastic and is of similar shape as the first portion 32 having a depth thereof that is slightly less so as to facilitate slidable securing within the interior volume of the first portion 32. The second portion 34 is slidably traversed within the interior volume of the first portion 32 so as to provide alternate heights of the vertical divider 30. It is contemplated within the scope of the present invention that the second portion 34 could be movable to numerous alternate positions so as to facilitate various heights of the vertical divider 30. While notches 75 are illustrated herein to provide height adjustment of the second portion 34, it is contemplated within the scope of the present invention that the height adjustment of the second portion 34 could be achieved utilizing various alternate elements.

The first portion 32 of the vertical divider 30 includes a bottom edge 29 having the first fastener 40 and second fastener 50 secured thereto on distal ends thereof. The first fastener 40 includes a support member 41 that has a curved portion 42 configured to extend rearwards from the front wall 39. The first fastener 40 is manufactured from a resilient material such as but not limited to metal. The second fastener 50 includes a first member 52 and second member 54 that are configured to extend downward from bottom edge 29. The second fastener 50 further includes void 53 intermediate the first member 52 and second member 54. Void 53 is configured to receive a portion of the rear support bar 13 therein and bias thereagainst. The vertical divider 30 is releasably secured to the horizontal shelves 10 wherein the first fastener 40 is secured to the front support bar 11 first and then the second fastener 50 is secured to the rear support bar 13. Ensuing securing of the vertical divider 30 to the horizontal shelves 10 the second portion 34 is moved in an upwards direction wherein the upper edge 39 thereof is adjacent the horizontal shelf 10 that is vertically adjacent thereto. The aforementioned is executed with a plurality of vertical dividers 30 so as to provide the desired segments 20.

While an embodiment of the first fastener 40 and second fastener 50 have been depicted and described herein, it is contemplated within the scope of the present invention that the first fastener 40 and second fastener 50 could be constructed in alternate manners so as to operably secure the vertical divider 30 to horizontal shelves 10 having another construction than that depicted herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shelving system comprising:

at least two support shelves, said at least two support shelves being oriented in a horizontal manner, said at least two support shelves having an upper surface configured to receive objects thereon, said at least two support shelves being arranged to have a lower shelf and an upper shelf; and at least one vertical divider, said at least one vertical divider configured to be releasably secured to the lower shelf of the at least two support shelves, said at least one vertical divider configured to be adjustable in height, said at least one vertical divider extending the depth of the one of said at least two support shelves to which the at least one vertical divider is secured, said at least one vertical divider having an upper perimeter edge, said upper perimeter edge being adjacent a lower surface of the upper shelf, wherein the at least one vertical divider includes a first portion and a second portion, wherein said second portion is slidably secured within said first portion, wherein the first portion of the at least one vertical divider includes a front wall, said front wall having a slot formed therein and wherein said slot formed on said front wall further includes a plurality of notches, said plurality of notches configured to provide alternate height adjustments for the second portion of the at least one vertical divider;

a first fastener and a second fastener, said first fastener and said second fastener configured to releasably secure the at least one vertical divider to one of said at least two support shelves, said first fastener and said second fastener being at one distal ends of the at least one vertical divider, said first fastener being curved in form and extending rearwards towards said second fastener;

a slider, said slider being operably coupled to said second portion of said at least one vertical divider, said slider being movably mounted within said slot, said slider providing an interface to move said second portion of the at least one vertical divider.

* * * * *